US006186613B1

(12) United States Patent
Watanabe

(10) Patent No.: US 6,186,613 B1
(45) Date of Patent: Feb. 13, 2001

(54) RECORDING HEAD AND RECORDING APPARATUS USING THE SAME

(75) Inventor: Yasutomo Watanabe, Hiratsuka (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 08/999,134

(22) Filed: Dec. 29, 1997

(30) Foreign Application Priority Data

Dec. 26, 1996 (JP) ..... 8-347398

(51) Int. Cl.[7] ..... B41J 29/38
(52) U.S. Cl. ..... 347/17
(58) Field of Search ..... 347/50, 20, 51, 347/52, 53, 54, 58, 59, 44, 47, 68, 69, 180, 181, 182

(56) References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 5,227,812 | 7/1993 | Watanabe et al. | 346/140 R |
| 5,477,247 * | 12/1995 | Kanegae | 347/20 |
| 5,576,748 | 11/1996 | Tamura | 347/58 |
| 5,600,354 * | 2/1997 | Hackleman et al. | 347/50 |
| 5,610,642 * | 3/1997 | Nobel et al. | 347/50 |
| 5,696,543 | 12/1997 | Koizumi et al. | 347/17 |

FOREIGN PATENT DOCUMENTS

| | | |
|---|---|---|
| 54-56847 | 5/1979 | (JP) . |
| 59-123670 | 7/1984 | (JP) . |
| 59-138461 | 8/1984 | (JP) . |
| 60-71260 | 4/1985 | (JP) . |

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

An ink jet head includes bump-shaped electrodes and of a recording element board and a drive element board, respectively. Of both electrodes, Young's modulus of a material forming the electrode is made smaller than Young's modulus forming the other bump-shaped electrode. With this construction, when the electrode and the electrode are press bonded to each other, since the electrode is relatively smaller in rigidity to the deformation, it deforms for itself thereby minimizing deformation in the electrode. As a result, when a new board is mounted, even if the electrode has an error, good bonding can be carried out.

13 Claims, 15 Drawing Sheets

RECORDING HEAD AND RECORDING APPARATUS USING THE SAME

This application is based on application No. 347,398/1996 filed Dec. 26, 1996 in Japan, the content of which is incorporated hereinto by reference.

BACKGROUND OF THE INVENTION

1. Field of the Invention

The present invention relates to a recording head and a recording apparatus using the same, more specifically to an electrical connection in a recording head between a recording element unit formed with a recording element and a drive element unit formed with a drive element for driving the recording element.

2. Description of the Related Art

As a recording element unit and a drive element unit forming a recording head used in a recording apparatus, those which are shown in FIG. 1A and FIG. 1B are known as examples. In FIG. 1A and FIG. 1B, a recording element unit 161 and a drive element unit 162 form a recording head of an ink-jet type, which are formed on a common base plate 1601. Specifically, the recording element unit 161 is composed of a heater 1607, a segment electrical wiring 1608, a common wiring electrode 1613, a common electrode wiring 1614, and the like, which are disposed on a substrate 1604 made of silicon (Si). On the other hand, the drive element unit 162 is composed of a drive element integrated circuit 1606 comprising transistors and the like, electrode wirings 1617 and 1618, and the like, which are disposed on a similar substrate 1605 to the substrate 1604. The respective substrates 1604 and 1605 are connected to the common base plate 1601 with an adhesive or the like. The recording element unit 161 and the drive element 162 are electrically connected one another by a bonding wire 1616.

Details of the recording element unit 161 are shown in FIG. 2. FIG. 2 is a vertical sectional view of the recording element unit shown in FIG. 1A. The heater 1607 for generating heat energy used for ejecting ink from an ejection port of the recording head is formed by connecting the segment electrode wiring 1608 and the common electrode wiring 1614 to a heat generation resistor layer 1620, and on a top layer thereof are formed an ink resistant layer 1654, a cavitation resistant layer, and the like, thereby generating a bubble in the ink utilizing the heat energy generated by the heater 1607, and the ink can be ejected by a pressure of the bubble.

As shown in FIG. 1A, FIG. 1B and FIG. 2, by providing a plurality of heat generation elements in the recording element unit 161, it is possible to obtain an ink-jet recording apparatus that can simultaneously make recording of a plurality of dots using the plurality of the heat generation elements, thereby achieving high-speed recording. In particular, nowadays with increasing requirement for high-density, high-speed recording, simultaneous recording of a plurality of dots in line arranged on a recording medium in a primary scanning direction is generally used. A recording unit is therefore developed in which a large number of heat generation elements (heaters) are disposed in a high density.

Meanwhile, in case that a plurality of heat generation elements are disposed in the recording element unit to make simultaneous recording of a plurality of dots, each heat generation element should be separately ON/OFF controlled. As means for making such a control, a drive element composed of transistors and the like is used as shown in FIG. 1A, FIG. 1B and FIG. 2. This drive element can be formed in the recording element unit, generally, it is independently formed on the respective substrates and then connected to the recording element unit as shown in FIG. 1A, FIG. 1B and FIG. 2. This is because, when the recording element and the drive element are integrally formed on a same substrate, the entire substrate per se will malfunction even when a malfunction occurs in any part of the recording element and the drive element and, in particular, when making a replacement of any elements, the above integrated substrate is required to be replaced.

In case that a recording element board formed with the recording unit and a drive element board formed with the drive unit are separately provided, as techniques for electrically connecting between the boards, there have been known a wire bonding method as shown in FIG. 1A, FIG. 1B and FIG. 2, and a method which uses an electrical connection member 1630 for electrical connection of the substrates 1604 and 1605 with each other as shown in FIG. 3.

In the wire bonding method, to prevent adjacent fine electrodes from contacts each other, a pitch for connecting between respective elements on the recording element board or the drive element board is however required to have some interval. The maximum number of connection parts is necessarily determined when the sizes of the recording element board and the drive element board are determined. In the wire bonding method, since the pitch size is normally as large as about 0.2 mm, the number of connection parts is required to be reduced. On the contrary, when the number of connection parts in the recording element board or the drive element board is previously determined, this means that the sizes of the recording element board and the drive element board have to be very long.

In the method of using an electrical connection member as shown in FIG. 3, there are requirements for size reduction and cost reduction.

As one which solves such problems, a construction for electrical connection as shown in FIG. 4 is proposed. That is, electrical connection is achieved by bump-shaped electrodes 1630*a* and 1630*b* which are protrudingly provided at an end of an electrode wiring. Compared with the above described wire bonding method and the method of using the electrical connection member, this method has advantages that high density wiring is extremely easy, compact construction and cost reduction are easy, and the like.

A construction of recording head using this method comprises a recording element having a wiring for supplying an electrical signal to the heater and a holder for holding the wiring, and a bump-shaped electrode protrudingly provided at an end of the wiring. A liquid passage communicating with an ejection port for ejecting the ink is provided in accordance with the heater as an energy generator of the recording element.

Another construction comprises a recording element unit including a recording element having a wiring for supplying an electrical signal to the heater and a holder for holding the wiring, and a bump-shaped electrode protrudingly provided at an end of the wiring, and a drive element unit having a drive element for driving the recording element and a wiring connected to the drive element, wherein the bump-shaped electrode and the wiring of the electrical drive element board are connected, and a liquid passage communicating with an ejection port for ejecting the ink is provided in accordance with the heater as an energy generator of the recording element.

In the above construction, a patterned wiring and the bump-shaped electrode are as follows: The patterned wirings of the recording element and drive element boards are formed on the surface of the holder. Further, when a protective layer for protection and insulation of the patterned wiring is formed on the surface of the holder, it is necessary to expose a sufficient area to form the bump-shaped electrode. The patterned wirings are formed of a conductive material such as Al or the like. A connection part comprising a bump-shaped electrode is formed on the patterned wiring of the recording element board.

The connection part comprising the bump-shaped electrode is for making electrical connection with another circuit boards. That is, "electrical connection" is achieved by directly bonding with connection part of other circuit boards and the like. Material of the bump-shaped electrode can be such metals as Cu, Ni, Au, Cr, Rh, or alloys thereof. The bump-shaped electrode and the patterned wiring may be integrally formed from the beginning of production, or after the patterned wiring is formed, the bump-shaped electrode may be formed on the patterned wiring.

Utilizing the above bump-shaped electrode, "bonding" is carried out as shown in FIG. 4. In this case, "bonding" provides particularly advantageous effects when the connection part of the recording element board and the connection part of the drive element board are bonded by a pressure bonding method. "Connection" may be "bonding" by metals or alloys, or may be "bonding" by a method by other than metals and alloys, and may be a combination of these methods with a pressure bonding method.

In this method, as already disclosed, it is important that positional deviations of tips of the bump-shaped electrodes due to surface curves or irregularities of the recording element board and the drive element board are absorbed to assure reliability of electrical connection between the recording element board and the drive element board.

However, in general, an electrical circuit board is not a perfectly flat plate but has some curves or irregularities, or due to heat evolution during driving, deflections may be generated. When there are large curves or irregularities as above, a connection failure may be generated in electrical connection of the recording element board with the drive element board.

To avoid this, it is preferable to strengthen the connections or use a substrate having no curves or irregularities. However, this method has a problem of a substantial increase in cost. Further, the above effect of curves will be increased as the heater arrangement direction of the recording element unit becomes longer. To solve such a problem, it is proposed to form a bump-shaped electrode through a layer of large thickness. With this method, a relatively good bonding can be made.

However, there are problems that cannot be satisfactorily solved even by the above-described methods. That is, in a construction in which a plurality of bump-shaped electrodes are arranged on a substrate and press bonded to obtain electrical connection, compared with reliability of the first press bonding, the reliability becomes deteriorated while repeating press bonding, and a connection failure may occur after some repetitions.

It has been elucidated by investigations thereafter that when the above bump-shaped electrodes are bonded with each other, since reliability of press bonding is increased by plastic deformation of these bump—shaped electrodes in a direction along its transverse sectional plane, when press bonding is repeated for replacement or the like of one board, reliability of connection may be deteriorated due to deformation of the bump-shaped electrodes.

On the other hand, in the already described recording element unit and the recording apparatus using the same, durability of the recording element unit is generally shorter than the service life of the recording apparatus.

Therefore, in a recording apparatus, when a malfunction occurs in the recording element unit, it is desirable to replace the recording element unit, the malfunctioned recording element unit must be replaced as simply as possible, and, after replacement, assured to have the same reliability as before replacement.

Further, it is general that the recording element board is shorter in service life compared with the drive element board. This is because a plurality of recording elements disposed in the recording element unit are substantially shorter in service life than drive elements of the drive element unit.

Under such circumstances, in the above-described recording apparatus, the recording unit, in particular its recording element board is frequently replaced. Further, when replacing the recording element board, the drive element board is naturally not required to be replaced. Further, from the cost point of view, the drive element board is a module comprising semiconductor devices and is thus high in cost, the drive element board is required to be used, as is, without replacement, even when the recording element board is replaced.

However, as already described, it has been found that in the connection arrangement using the bump-shaped electrodes, reliability of bonding is deteriorated during repeated press bonding, and unbonded devices are generated.

FIGS. 5A to 5E are schematic side views showing this condition, respectively.

As shown in FIGS. 5A and 5B, when the recording element board 1604 and the drive element board 1605 are connected with each other, the bump-shaped electrodes 1630*a* and 1630*b* are press bonded with one another. In this case, if there are errors in height or positional deviations or irregularities on the substrate in three bump-shaped electrodes 1630*b* of the recording element board 1604, the bump-shaped electrode 1630*a* of the drive element board is irregularly deformed by height errors and the like of the bump-shaped electrodes 1630*b* of the recording element board. When the recording element board 1604 is removed for replacement (FIG. 5C), and a new different board 1604 is mounted (FIG. 5B), an unbonded bump-shaped electrode may be generated because of the above irregular deformation generated by press bonding with the former board 1604 (FIG. 5E).

With a view to eliminate the above problems, an object of the present invention is to provide a recording head which can prevent deterioration of reliability of press bonding of a bump-shaped electrode due to repeated bonding between circuit boards and a recording apparatus using the same.

SUMMARY OF THE INVENTION

The object of the present invention is achieved by a recording head comprising a recording element unit provided with recording elements and a drive element unit provided with drive elements for driving the recording elements of the recording element unit, wherein the recording element unit and the drive element unit respectively have pairs of bump-shaped electrodes for electrical connection between the two units by mutual bonding, Young's modulus of a material forming one bump-shaped electrode of the two units is smaller than Young's modulus of a material forming the other bump-shaped electrode.

Here, the one bump-shaped electrode formed of a material of relatively smaller Young's modulus may have a shape of decreasing in sectional area towards the bonding direction.

With the above construction, since Young's modulus of a material forming one bump-shaped electrode of the two units is smaller than Young's modulus of the other bump-shaped electrode, rigidity to deformation of the one bump-shaped electrode is smaller than rigidity to deformation of the other bump-shaped electrode, during bonding, the one bump-shaped electrode of smaller Young's modulus deforms for itself, and no deformation is generated in the other bump-shaped electrode. When one unit provided with the bump-shaped electrode of smaller Young's modulus is replaced with new one, and the new unit is bonded with the other unit, since deformation is not generated in the bump-shaped electrode of the other unit in a direction along its transverse sectional plane, length of the bump-shaped electrode is not made uneven, no clearance is generated between the bump-shaped electrode of the opposing unit, and unbonded condition will not generate between both units.

Here, the above-described Young's modulus will be described.

For example, where a stress exerted on the cross sectional plane of a rod-formed body is represented by T, a contraction per a unit length of the rod-formed object is represented by $\epsilon$, and when the relationship of $T=E\epsilon$ is met within a proportion limit, Young's modulus is represented by $E=T/\epsilon$. That is, that Young's modulus ($E=T/\epsilon$) of a rod-formed body A is smaller than Young's modulus of a rod-formed body B means that the contraction $\epsilon$per unit length of the rod-formed body A is large if both the stresses T exerted on the rod-formed bodies A and B are equal to each other. Therefore, in the present invention, when the rod-formed body A and the rod-formed body B are butt joined, both bodies are applied with the same stress T, deformation is generated only at the rod-formed body A side which is relatively small in Young's modulus, and no deformation is generated in the rod-formed body B side which is relatively large in Young's modulus.

Further, the object of the present invention is achieved by a recording head comprising a recording element unit provided with recording elements and a drive element unit provided with drive elements for driving the recording elements of the recording element unit, wherein the recording element unit and the drive element unit respectively have pairs of bump-shaped electrodes for electrical connection between the two units by mutual bonding, and one bump-shaped electrode of the two units has a shape of decreasing in sectional area towards the bonding direction.

Specifically, with a construction that the bump-shaped electrodes are different from each other in Young's modulus, and that the bump-shaped electrode at the recording element unit side of frequent replacement is further formed to have, e.g., a tapering-off shape, whereby the same advantageous effect as above can be obtained.

In short, in the present invention, bump-shaped electrodes for making electrical connection between two units are assumed to be deformed at the time of bonding, the deformation is generated by a bump-shaped electrode provided on one unit, only the deformed side unit is subject to replacement, and the new unit and a non-deformed side unit are bonded, thereby assuring reliability of electrical connection between both the units.

The above and other objects, effects, features and advantages of the present invention will become more apparent from the following description of embodiments thereof taken in conjunction with the accompanying drawings.

BRIEF DESCRIPTION OF THE DRAWINGS

FIG. 7A and FIG. 7B are schematic views for explaining production process of the recording element board according to an embodiment of the present invention, in which FIG. 7A is a plan view, and FIG. 7B is a vertical sectional view taken along line VIIB–VIIB' of FIG. 7A;

FIG. 8A to FIG. 8C are schematic views for explaining one of production process of the recording element board according to an embodiment of the present invention, in which FIG. 8A is a plan view, FIG. 8B and FIG. 8C are vertical sectional views taken along line VIIIB–VIIIB' and line VIIIC–VIIIC' of FIG. 8A;

FIG. 9A to FIG. 9C are schematic views for explaining one of production process of the recording element board according to an embodiment of the present invention, in which FIG. 9A is a plan view, FIG. 9B and FIG. 9C are vertical sectional views taken along line IXB–IXB' and line IXC–IXC' of FIG. 9A;

FIG. 10A to FIG. 10C are schematic views for explaining one of production process of the recording element board according to an embodiment of the present invention, in which FIG. 10A is a plan view, FIG. 10B and FIG. 10C are vertical sectional views taken along line XB–XB' and line XC–XC' of FIG. 10A;

FIG. 11A to FIG. 11C are schematic views for explaining one of production process of the recording element board according to an embodiment of the present invention, in which FIG. 11A is a plan view, FIG. 11B and FIG. 11C are vertical sectional views taken along line XIB–XIB' and line XIC–XIC' of FIG. 11A;

FIG. 12A to FIG. 12C are schematic views for explaining one of production process of the recording element board according to an embodiment of the present invention, in which FIG. 12A is a plan view, FIG. 12B and FIG. 12C are vertical sectional views taken along line XIIB–XIIB' and line XIIC–XIIC' of FIG. 12A;

DETAILED DESCRIPTION OF PREFERRED EMBODIMENTS

In the following, embodiments of the present invention will be described in detail with reference to the drawings.

FIGS. 6A to 6E are views showing deformation conditions of respective electrodes when respective bump-shaped electrodes of the recording element board and the drive element board according to an embodiment of the present invention are repeatedly bonded and removed.

The respective units of the recording element board and the drive element board of the present embodiment are similar to those described above in terms of the construction shown in FIG. 4, except for the material for the bump-shaped electrode shown in FIG. 6, therefore, illustration of similar elements and description thereof are omitted.

In the present embodiment, Young's modulus of material of a bump-shaped electrode 1631*b* of the recording element board 1604 is made smaller than Young's modulus of material of a bump-shaped electrode 1631*a* of the drive element board 1605. Thus, the bump-shaped electrode 1631*b* of the recording element board 1604 is smaller in rigidity to deformation in the press bonding direction than the bump-shaped electrode 1631*b* of the drive element board 1605.

Figure 6A:
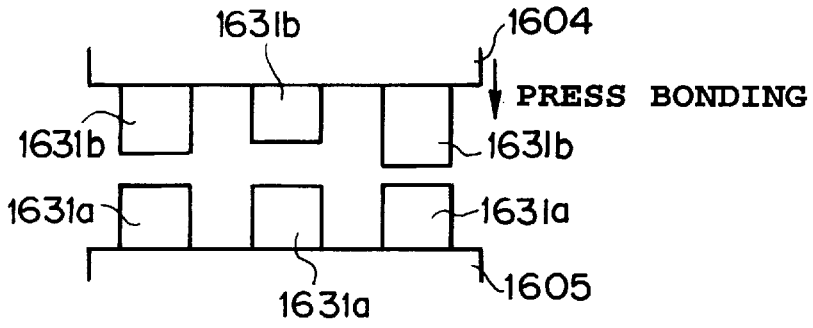
FIG. 6A to FIG. 6E are schematic side views for explaining shape of a bump-shaped electrode according to an embodiment of the present invention and bonding thereof.
Figure 6B:
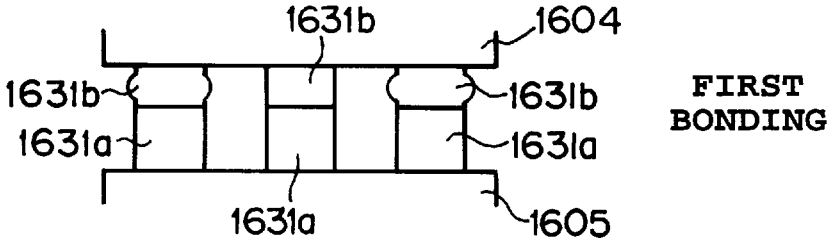
Figure 6C:
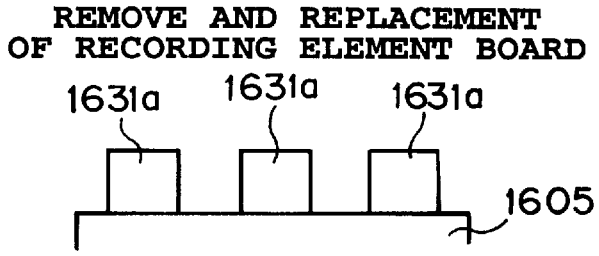
Figure 6D:
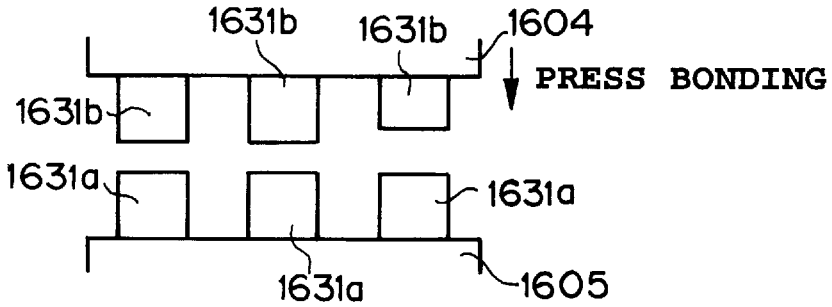
Figure 6E:
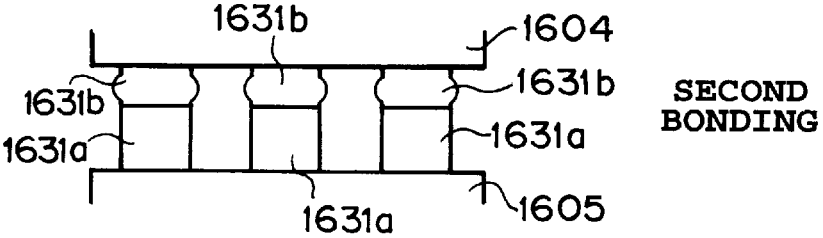
Figure 7B:
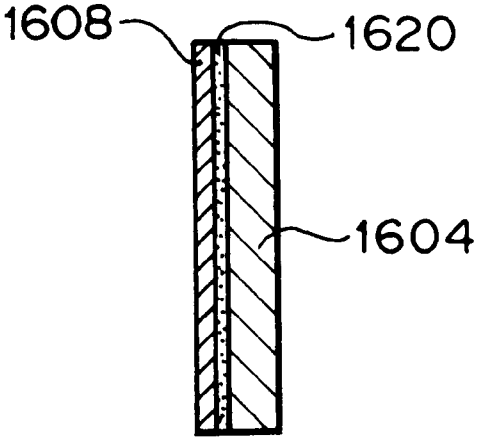
Figure 7A:
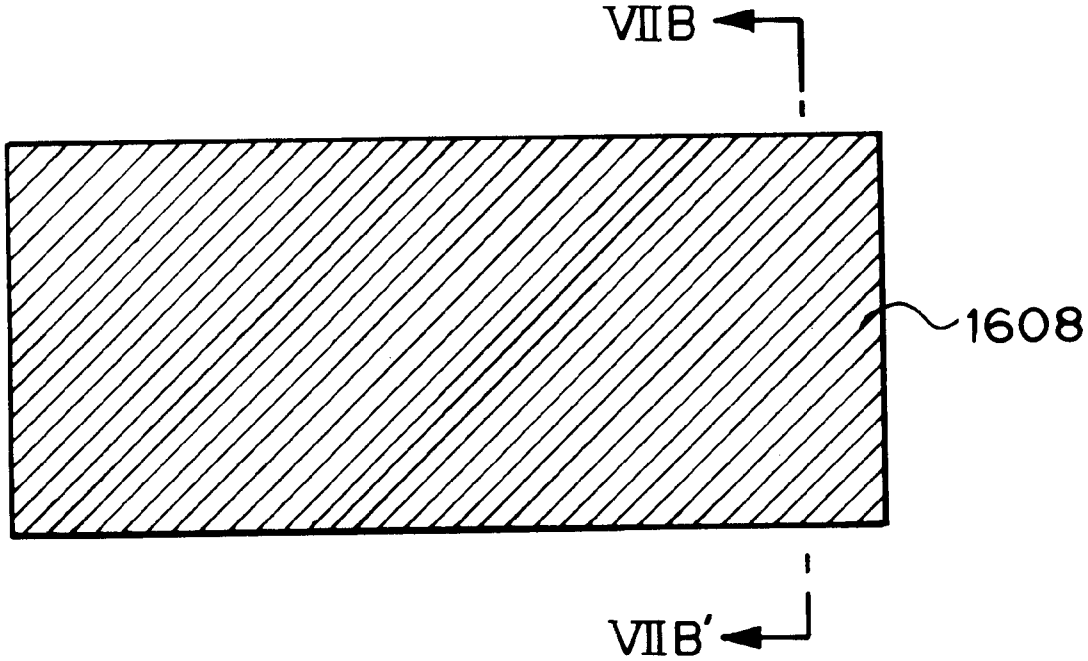

As a result, for example, even when the bump-shaped electrodes of the recording element board 1604 which is first mounted have errors in height (FIG. 6A), when press bonded with the bump-shaped electrodes at the drive element side, they deform in themselves to minimize deformation in the bump-shaped electrodes 1631*a* (FIG. 6B, FIG. 6C). This avoids unbending between bump-shaped electrodes with each other at the next bonding, and by deformation of the bump-shaped electrodes 1631*b* at the recording element board side as in the first bonding, thereby minimizing deformation in the bump-shaped electrodes 1631*a* at the drive element side.

Showing combinations of materials of the bump-shaped electrodes which can be applied to the present invention, when the bump-shaped electrodes of relatively smaller in Young's modulus are composed mainly of gold such as pure gold or gold alloys, the bump-shaped electrodes of relatively greater in Young's modulus are composed of zinc, Invar brass, tungsten, titanium, iron, copper, nickel, platinum, palladium, molybdenum, phosphor bronze, or combinations or alloys thereof. Combinations of materials of the bump-shaped electrodes are more specifically shown in the following table 1.

Bump-shaped electrodes of the recording element board and the drive element board are made of materials as listed in Table 1, respectively. The recording element boards were replaced after experiment of bonding. On the other hand, the drive element boards were repeatedly used several times.

Repetition of electrical connection between the both boards is estimated. "Excellent connection" is represented by "A", "good connection" is represented by "B", and "not preferable connection" is represented by "C".

| | Recording Element Board | Young's modulus ($\times 10^{10}$ Pa) | Drive element board | Young's modulus ($\times 10^{10}$ Pa) | Estimation |
|---|---|---|---|---|---|
| Sample 1 | Au | 7.8 | Ti | 11.6 | A |
| Sample 2 | Au | 7.8 | Cu | 13 | A |
| Sample 3 | Au | 7.8 | Ni | 21 | A |
| Sample 4 | Au | 7.8 | Pt | 17 | A |
| Sample 5 | Au | 7.8 | Au | 7.8 | C |
| Sample 6 | Au | 7.8 | Ag | 8.3 | B |
| Sample 7 | Au | 7.8 | Sn | 5 | C |
| Sample 8 | Au | 7.8 | Brass | 10 | B |
| Sample 9 | Au | 7.8 | Pd | 11.3 | A |
| Sample 10 | Cu | 13 | Ti | 11.6 | C |
| Sample 11 | Cu | 13 | Cu | 13 | C |
| Sample 12 | Cu | 13 | Ni | 21 | A |
| Sample 13 | Cu | 13 | Pt | 17 | A |
| Sample 14 | Cu | 13 | Au | 7.8 | C |
| Sample 15 | Cu | 13 | Ag | 8.3 | C |
| Sample 16 | Cu | 13 | Sn | 5 | C |
| Sample 17 | Cu | 13 | Brass | 10 | C |
| Sample 18 | Cu | 13 | Pd | 11.3 | A |
| Sample 19 | Sn | 5 | Ti | 11.6 | A |
| Sample 20 | Sn | 5 | Cu | 13 | A |
| Sample 21 | Sn | 5 | Ni | 21 | A |
| Sample 22 | Sn | 5 | Pt | 17 | A |
| Sample 23 | Sn | 5 | Au | 7.8 | A |
| Sample 24 | Sn | 5 | Ag | 8.3 | A |
| Sample 25 | Sn | 5 | Sn | 5 | C |
| Sample 26 | Sn | 5 | Brass | 10 | A |
| Sample 27 | Sn | 5 | Pd | 11.3 | A |
| Sample 28 | Pd | 11.3 | Ti | 11.6 | B |
| Sample 29 | Pd | 11.3 | Cu | 13 | B |
| Sample 30 | Pd | 11.3 | Ni | 21 | A |
| Sample 31 | Pd | 11.3 | Pt | 17 | A |
| Sample 32 | Pd | 11.3 | Au | 7.8 | C |
| Sample 33 | Pd | 11.3 | Ag | 8.3 | C |
| Sample 34 | Pd | 11.3 | Sn | 5 | C |
| Sample 35 | Pd | 11.3 | Brass | 10 | C |
| Sample 36 | Pd | 11.3 | Pd | 11.3 | C |

As seen from Table 1, it is preferable that difference of Young's modulus between the bump-shaped electrodes of the recording element boards and the drive element boards is more than $2.8\times10^{10}$ Pa.

In the recording head having the bump-shaped electrodes of such material combinations, for example, even when a malfunction occurs in the recording element board which is required to be replaced, it is possible to make replacement without impairing reliability of electrical connection by the replacement.

FIG. 7A and FIG. 7B to FIG. 13 are views for explaining the production process of the recording element unit described in FIG. 1, FIG. 4 and FIG. 6A to FIG. 6E.

Figure 8C:
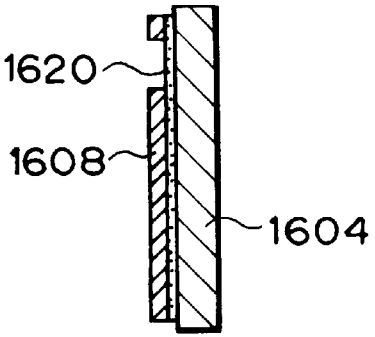
Figure 8B:
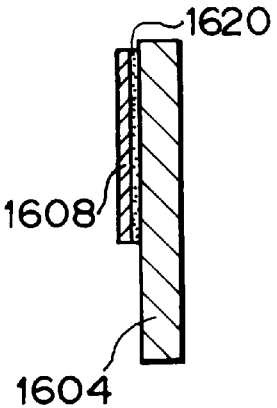
Figure 8A:
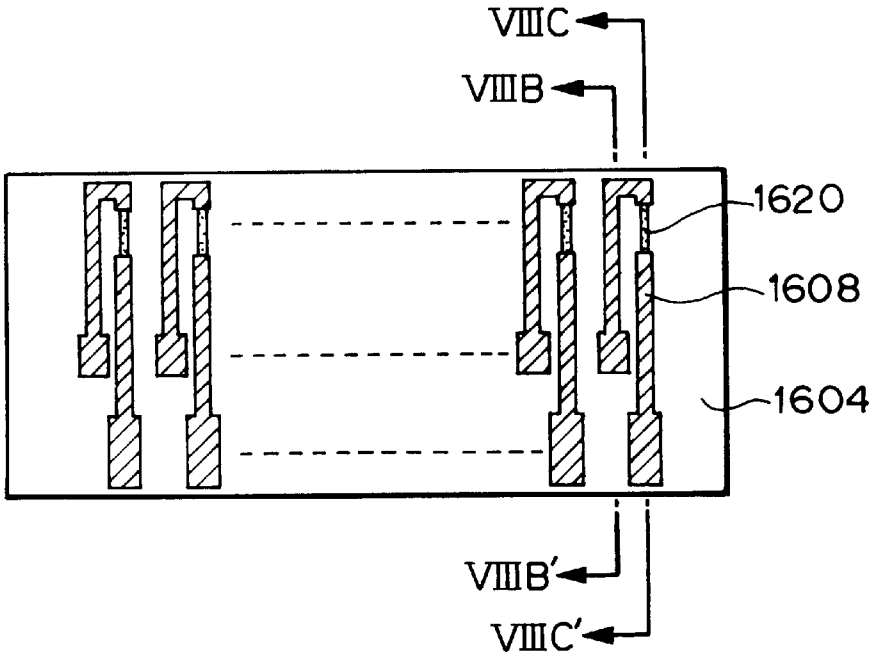

First, $HfB_2$ to be a heat generation resistor layer is formed to a thickness of 350 $\mu$m, Ti is formed to a thickness of 50 $\mu$m, and Al forming the electrode 1608 is formed to a thickness of 6000 $\mu$m, respectively on the substrate 1608 by sputtering (FIG. 7). On the films formed above, using photolithography, a resist is coated, exposed, and developed for patterning, the above films are formed into wiring by etching, and then the resist is peeled. Further, on the board as formed above, resist is patterned using the same photolithography as above, and Al is partly removed by etching to form a heater part. The resist is peeled after etching (FIG. 8).

Figure 9C:
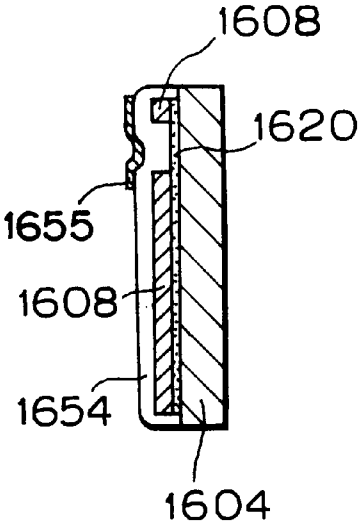
Figure 9B:
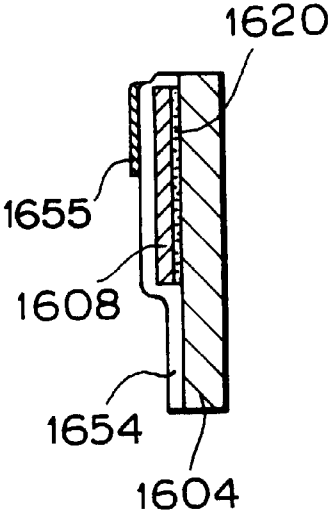
Figure 9A:
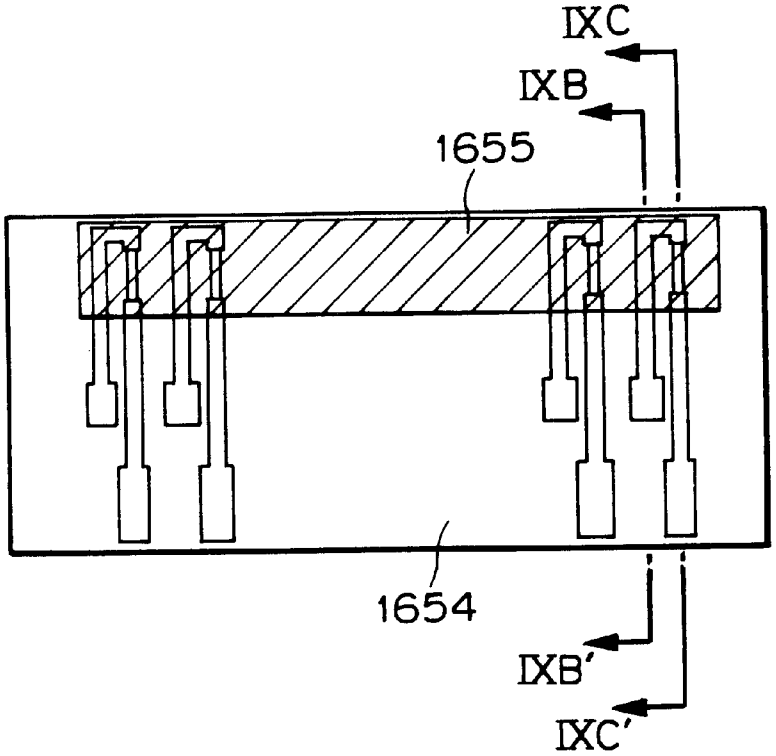
Figure 10C:
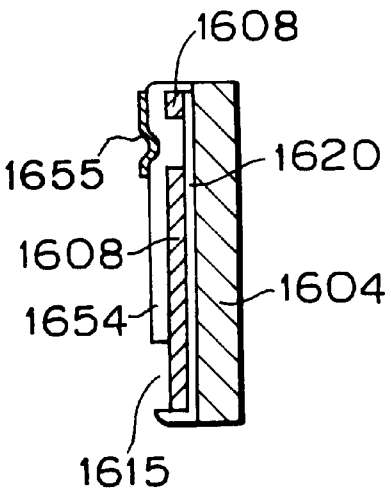
Figure 10B:
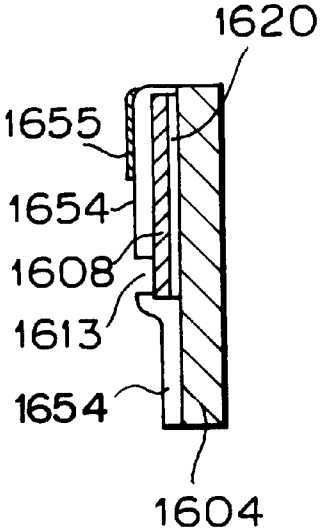
Figure 10A:
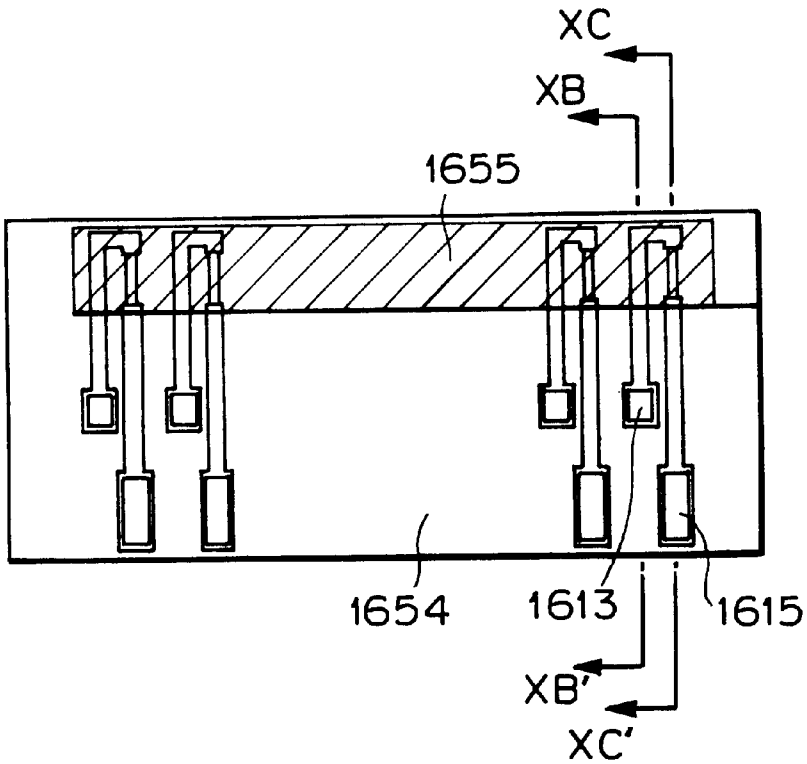

Next, a $SiO_2$ layer 900 $\mu$m as a heater oxidation resistant layer and an interlayer insulation layer and Ta 5000 $\mu$m as a cavitation resistant layer 1655 are formed by continuous sputtering on the entire surface of the board (FIG. 9A to FIG. 9C). Further, the resist is patterned by the method as described above, and Ta is partly removed by etching to form a Ta pattern. Still further, $SiO_2$ is patterned by the same method. An organic insulation film 2.5 μm as an ink resistant layer and an interlayer insulation layer is coated, and pattern formed by the same method as above, or a photosensitive organic insulation film is coated, exposed, and developed to form a pattern (FIG. 10A to FIG. 10C).

Figure 11C:
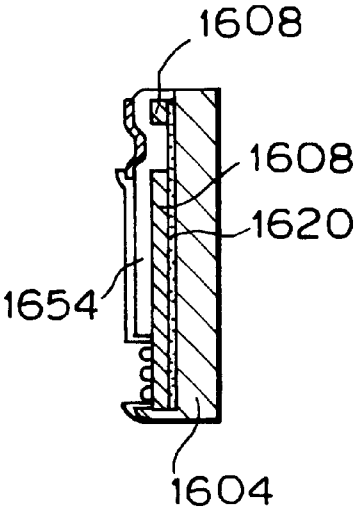
Figure 11B:
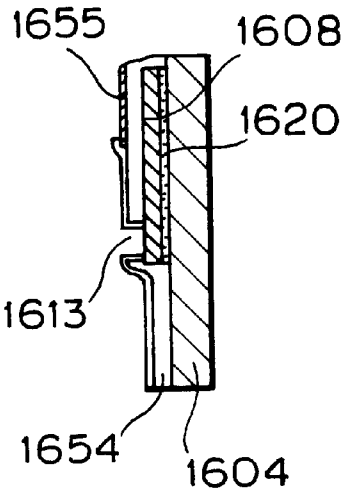
Figure 11A:
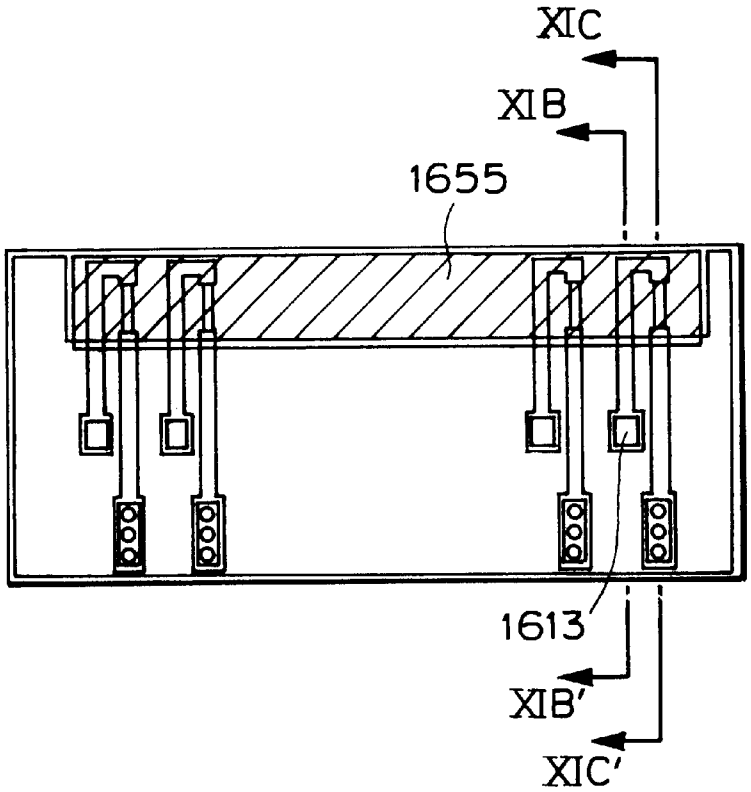

Next, as an electroplating underlayer, Cu 3000 μm and Ti 500 μm are formed on the entire surface of the board (FIG. 11A to FIG. 11C).

Figure 12C:
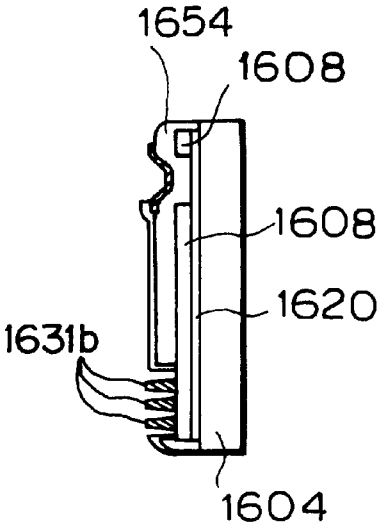
Figure 12B:
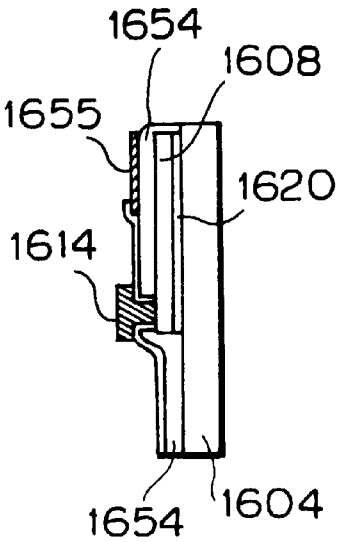
Figure 12A:
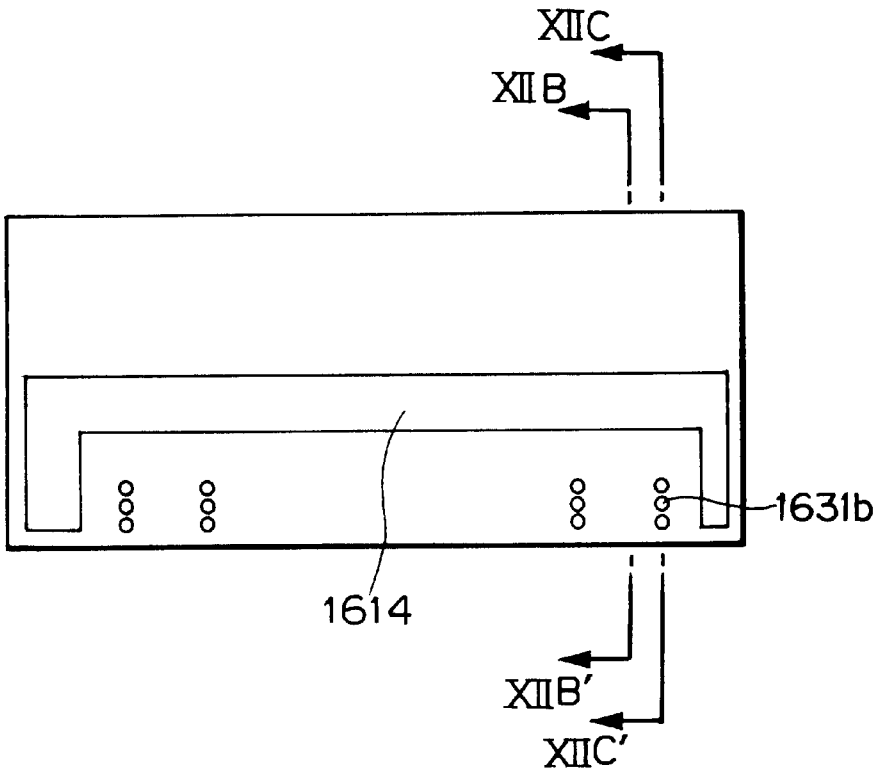

A plating formation resist is coated, exposed, and developed. As the resist, PMER-AR900 of Tokyo Oka is used, which is normally coated, exposed, developed, and then subjected to plasma ashing. For example, the resist thickness is 25 microns. With ashing conditions of a vacuum of 1 torr, an oxygen gas pressure of 500 sccm, a board temperature of 25 deg., a power of 1 kW, and an ashing time of 10 to 20 minutes, the above resist pattern is formed into an inverse tapered cross section. The taper angle can be controlled to some extent by the ashing time, the longer the time, the more increased the inverse taper state. Using the plating resist formed as above, a plating of Au, Ni, Cu, Pt, Pd, In, or solder is formed to a thickness of several microns to several tens of microns by an electroplating method. Finally, the resist is peeled (FIG. 12A to FIG. 12C).

Figure 13:
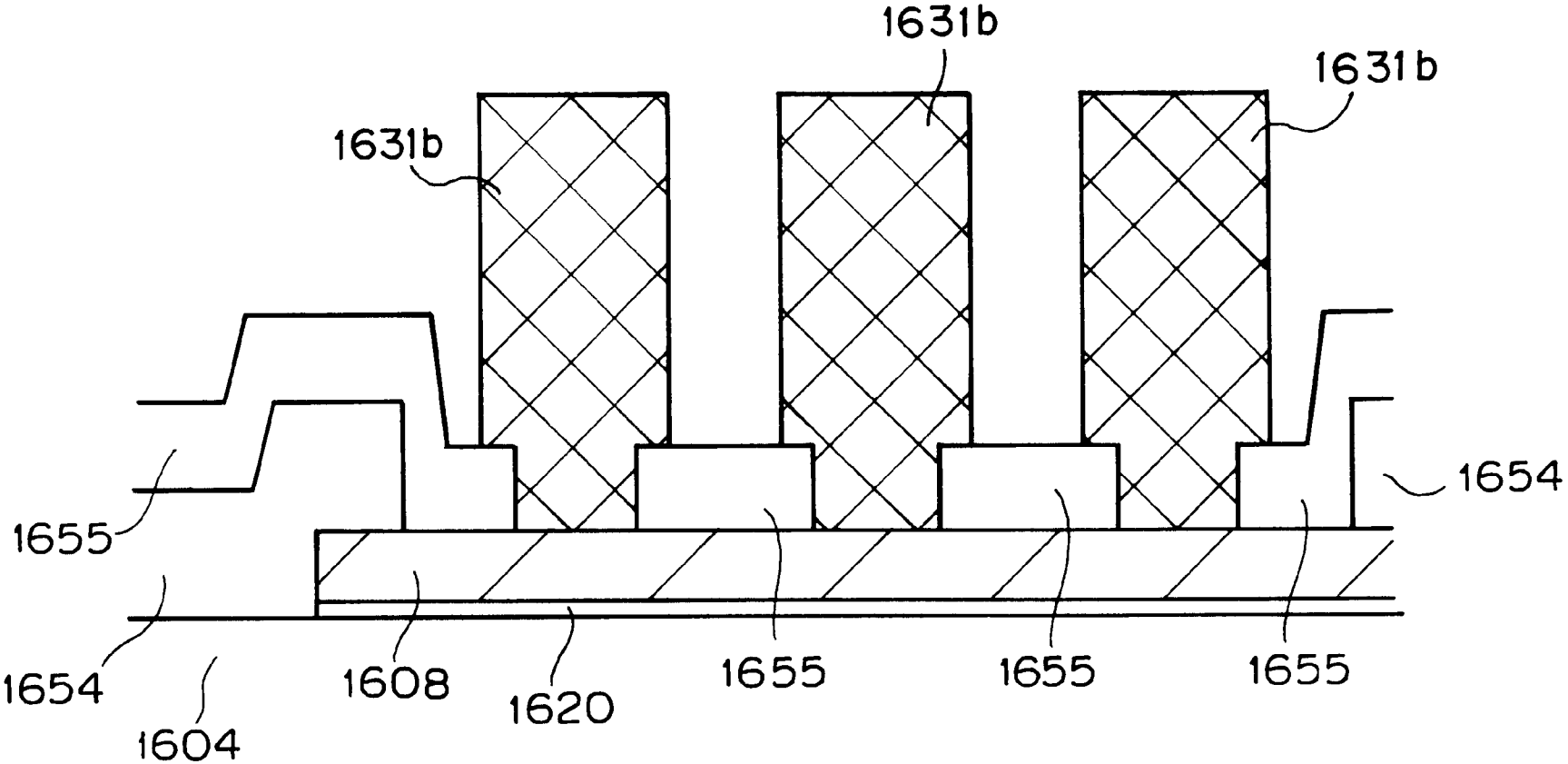
FIG. 13 is a schematic enlarged sectional view showing the bump-shaped electrode formed in the production process shown in FIG. 7A to FIG. 12C.

Details of bump-shaped electrodes of the recording element board produced by the above process are shown in FIG. 13.

On the other hand, for the drive element board, a wiring electrode pattern, an interlayer distance pattern, and bump-shaped electrodes can be formed on the holder by the same method as described above.

Figure 1B:
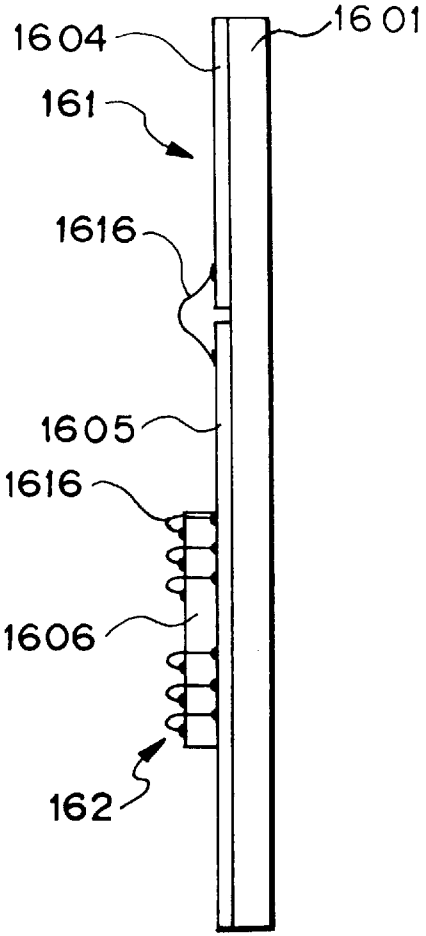
FIG. 1B (PRIOR ART)
FIG. 1A and FIG. 1B are a schematic plan view and a schematic side view respectively showing a recording element board and a drive element board constituting an ink-jet head.
Figure 1A:
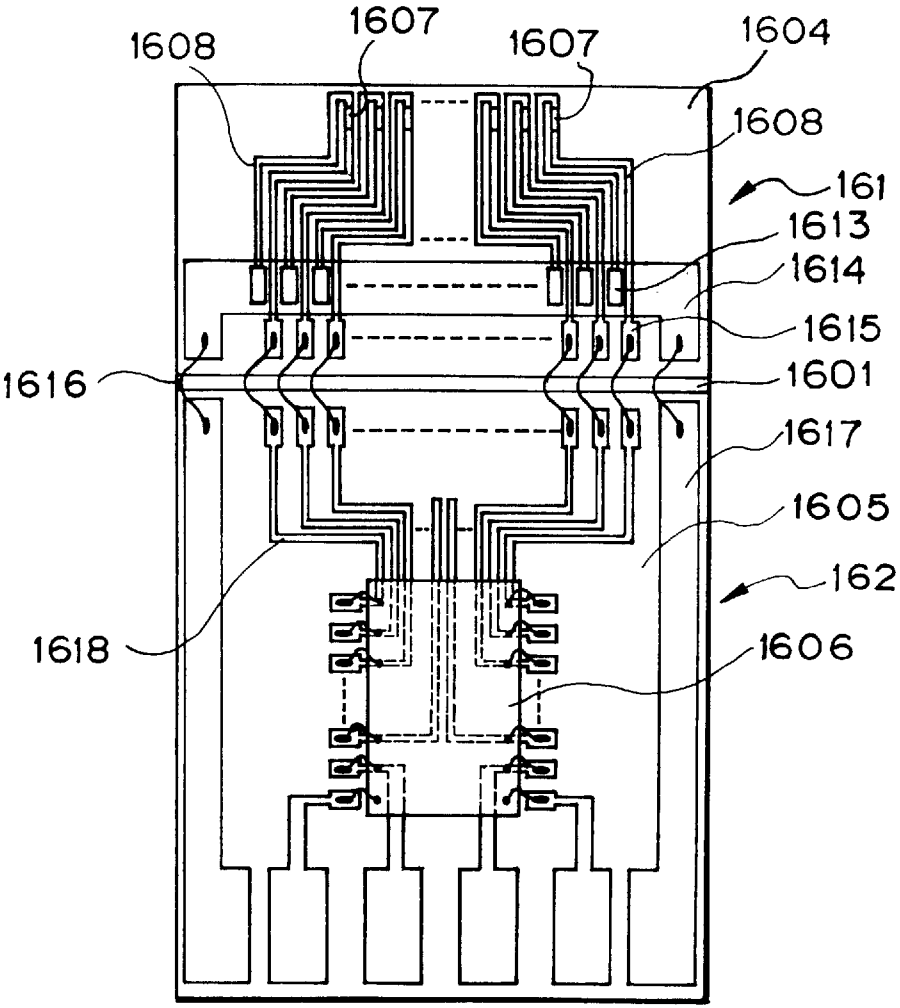
FIG. 1A (PRIOR ART)
Figure 2:
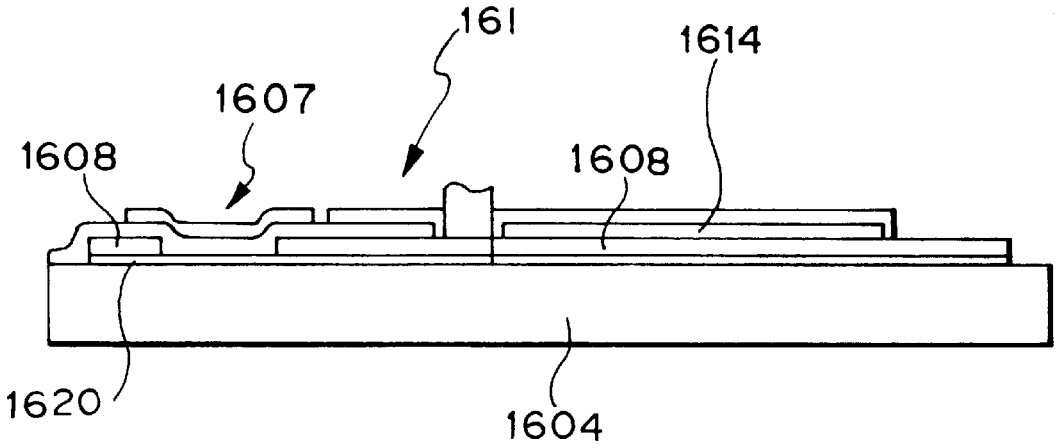
FIG. 2 (PRIOR ART)
FIG. 2 is a schematic vertical sectional view of the recording element board shown in FIG. 1A.
Figure 3:
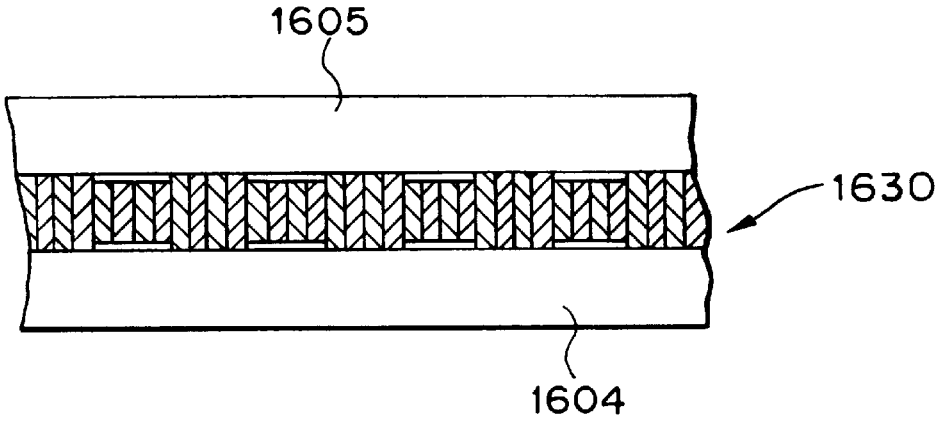
FIG. 3 (PRIOR ART)
FIG. 3 is a schematic vertical sectional view showing an example of construction for electrical connection of the recording element board and the drive element board.
Figure 4:
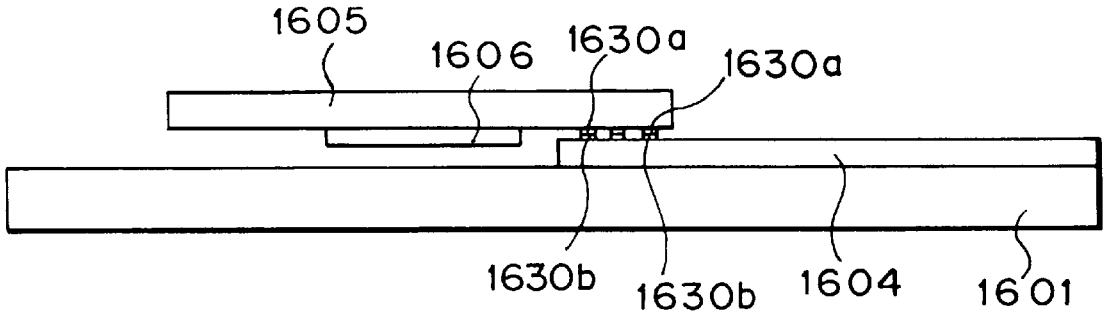
FIG. 4 (PRIOR ART)
FIG. 4 is a schematic side view showing an example of construction for electrical connection of the recording element board and the drive element board.
Figure 5A:
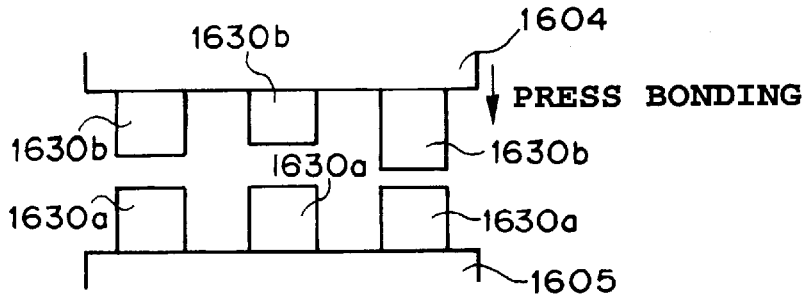
FIG. 5A (PRIOR ART)
FIG. 5A to FIG. 5E are schematic side views for explaining bonding of a prior art example of a bump-shaped electrode for electrical connection shown in FIG. 4 and deformation thereof.
Figure 5B:
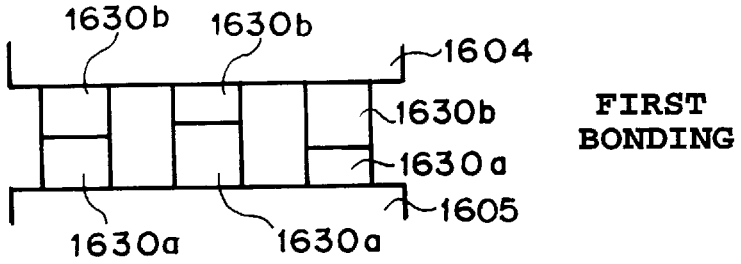
FIG. 5B (PRIOR ART)
Figure 5C:
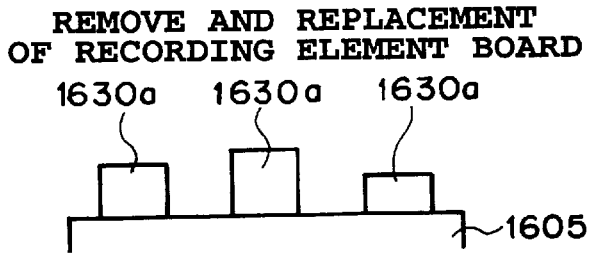
FIG. 5C (PRIOR ART)
Figure 5D:
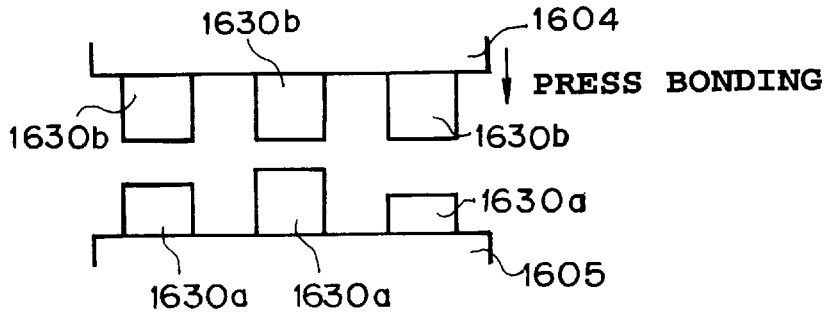
FIG. 5D (PRIOR ART)
Figure 5E:
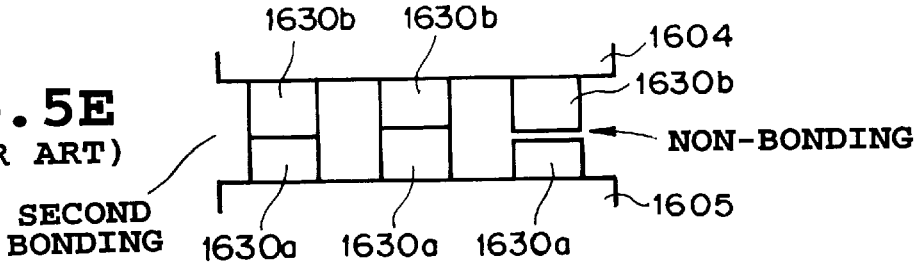
FIG. 5E (PRIOR ART)

The recording element unit constructed using the thus formed recording element board and the drive element board is the same as shown in FIG. 4 except for the bump-shaped electrodes.

Figure 14:
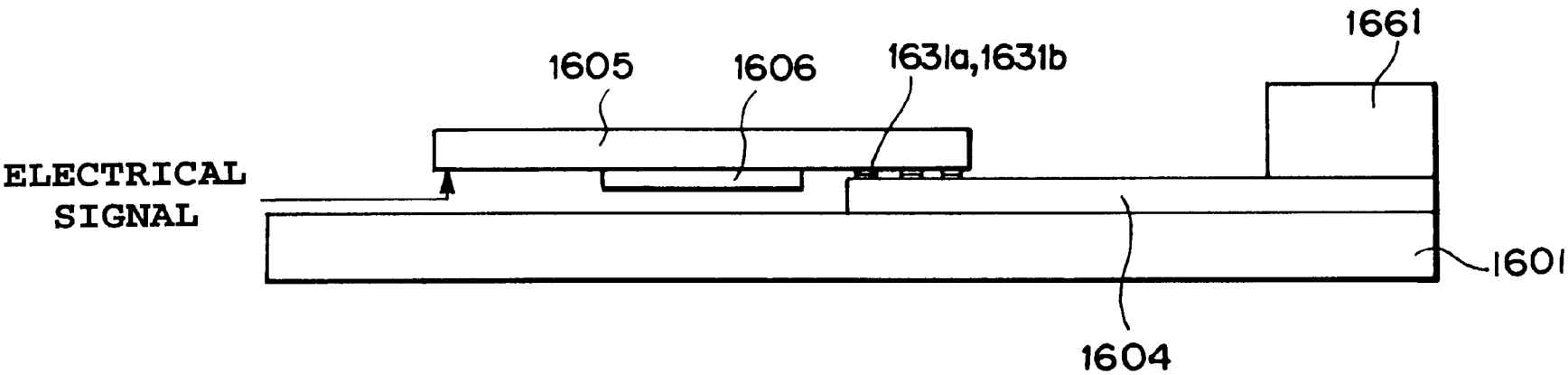
FIG. 14 is a schematic vertical sectional view showing an ink-jet head according to an embodiment of the present invention.

FIG. 14 is a view showing an ink jet head formed by connecting the recording element unit formed by bonding a top plate for forming ejection ports for ejecting ink and liquid passages communicating therewith to the recording element board formed as above, and an ink jet drive unit composed of the same drive element board.

Figure 15:
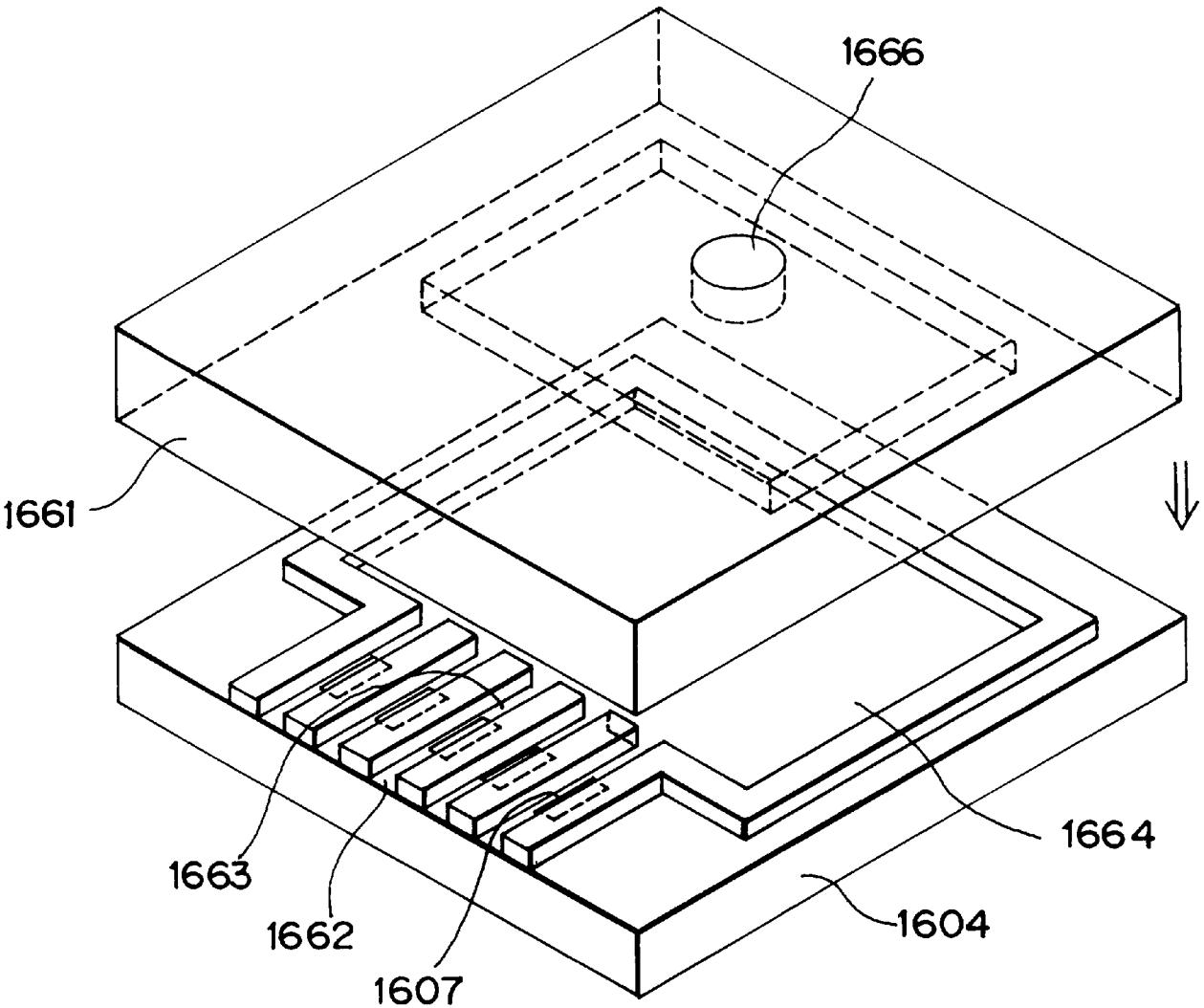
FIG. 15 is a schematic exploded perspective view showing an ink ejection port of the above ink jet head at the center.

Further, FIG. 15 is an exploded perspective view showing details of the part of ink jet head connected with the top plate 1661, wherein ink ejection ports 1662, liquid passages communicating therewith, and a common liquid chamber 1664 are formed. The respective liquid passages 1663 are provided with heaters 1667, and the top plate 1661 is provided with a supply port 1666 for supplying ink.

Figure 16:
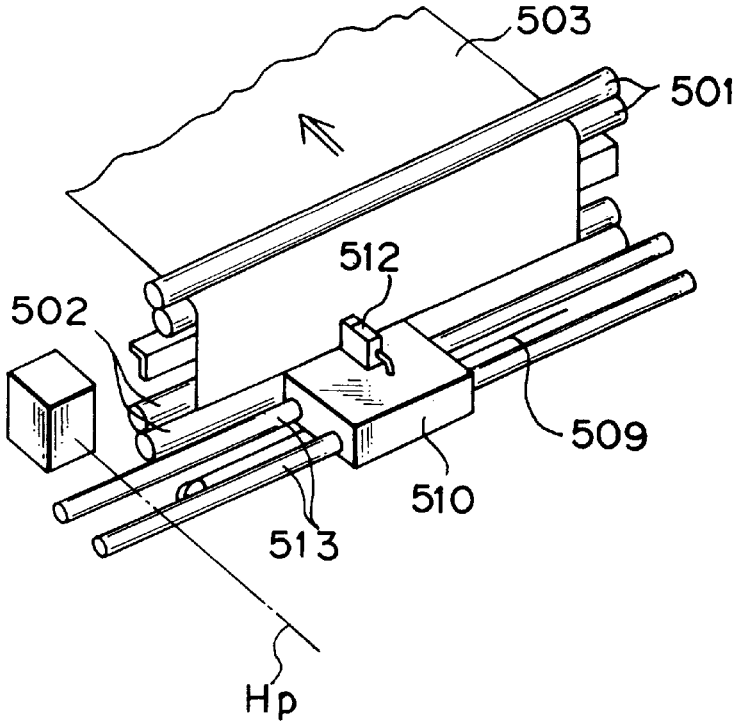
FIG. 16 is a schematic perspective view showing an ink jet recording apparatus using the ink jet of the above embodiment.

FIG. 16 is a view showing an example of ink jet recording apparatus of the present embodiment.

In FIG. 16, a recording sheet 503 as a recording medium is transported by paper feed rollers 502 to sheet feed rollers 501 disposed with predetermined spacings above and below, and sheet fed in a direction of arrow A. Further, on the entire surface of the recording sheet, a carriage 510 moving along a guide shaft 513 is provided. The carriage 510 is a support for supporting the ink jet head 512 so that the ejection port of the abovedescribed ink jet head 512 opposes the upper surface of the recording sheet with a predetermined spacing. In the shown example, the ink jet head 512 is mounted on the carriage 510. The carriage 510 is reciprocally driven by a carriage drive motor through a transmission mechanism such as a belt 501.

In recording, ink is ejected towards the recording sheet from the ejection port of the ink jet head 512 in synchronization with scanning in a recording sheet width direction of the carriage 510 to make recording.

Figure 17:
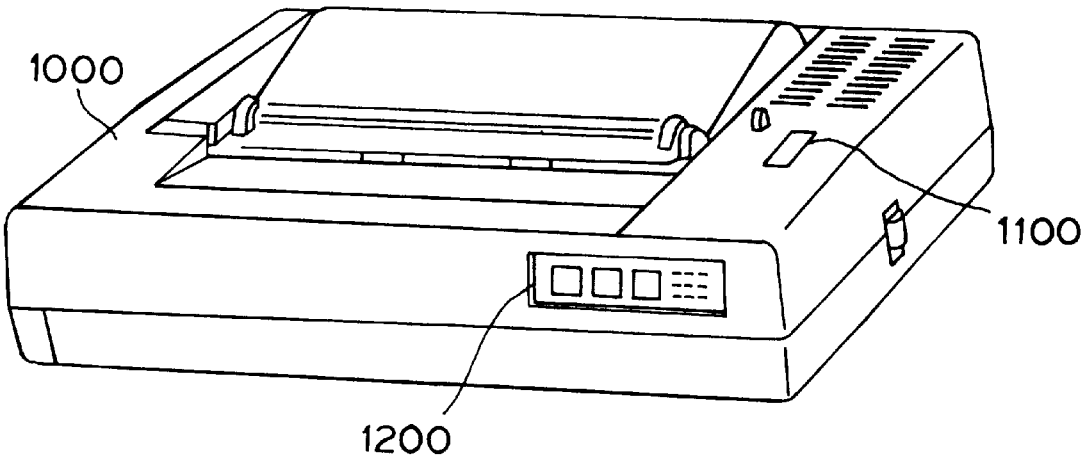
FIG. 17 is a schematic perspective view showing an outer appearance of a printer using the above recording apparatus.

FIG. 17 is a perspective view showing an example of printer using the ink jet recording apparatus. Basically, a printer is constructed by covering the ink jet recording apparatus shown in FIG. 16 with an outer case 1000. The case 1000 is provided with a scanning unit and the like.

Figure 18:
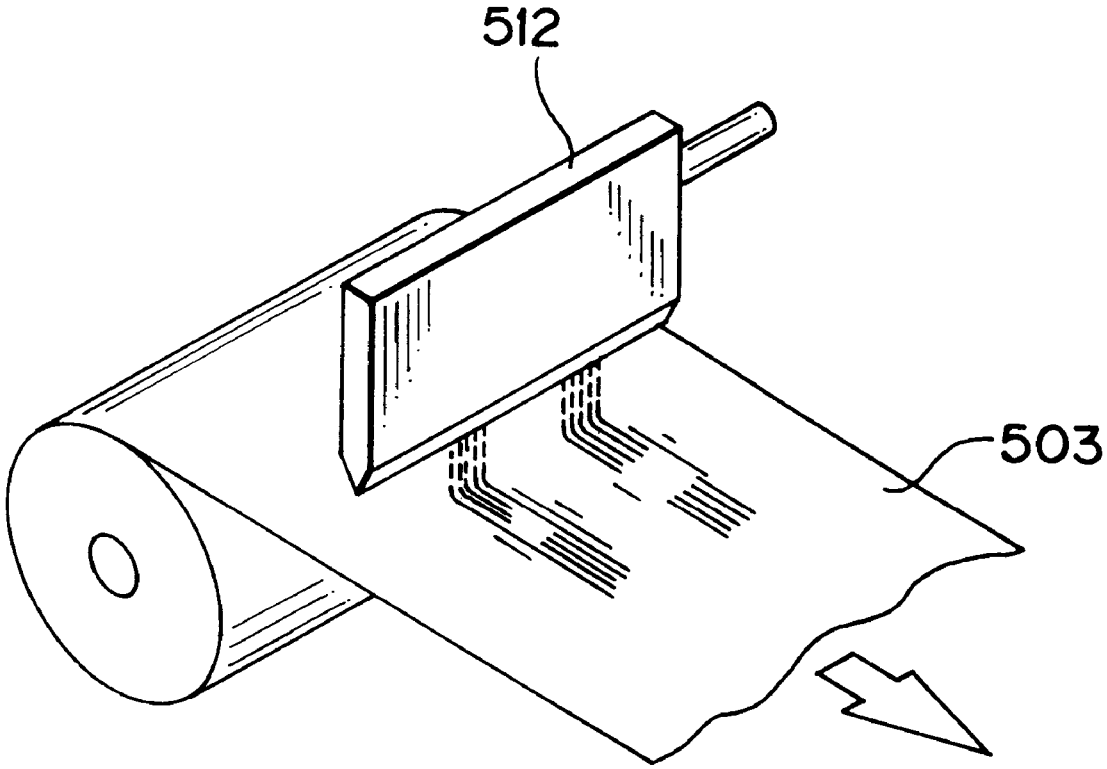
FIG. 18 is a schematic perspective view showing an ink jet recording apparatus using an ink jet head according to another embodiment of the present invention.

FIG. 18 is a schematic perspective view showing another example of the ink jet recording apparatus. A difference thereof from the apparatus shown in FIG. 16 is that the ink jet head is provided with ink ejection ports corresponding to a recording width of transported recording paper and fixed. That is, the carriage is not required to be reciprocally moved, and therefore the mechanism is simple and is possible to make high-speed recording. The present invention is particularly effective when such a relatively long-sized head is used.

As is apparent from the above description, with the present invention, since Young's modulus of a material forming one of bump-shaped electrodes of two units is made smaller than Young's modulus of the other electrode, rigidity to deformation of the one bump-shaped electrode of relatively smaller in Young's modulus is smaller than rigidity to deformation of the other bump-shaped electrode, during bonding, the one bump-shaped electrode of relatively smaller Young's modulus deforms for itself, and no deformation is generated in the other bump-shaped electrode. When one unit provided with the bump-shaped electrode of smaller Young's modulus is replaced with new one, and the new unit is bonded with the other unit, since deformation is not generated in the bump-shaped electrode of the other unit, unbonded state is not generated. Using such bump-shaped electrodes, deterioration of reliability of electrical connection in the recording head can be prevented.

Further, with the construction that the bump-shaped electrodes are different from each other in Young's modulus, and that the bump-shaped electrode at the recording element unit side of more frequent replacement compared with the drive element unit is further formed to have, e.g., a tapering-off shape towards the bonding direction in order to positively induce deformation, whereby the same advantageous effect as above can be obtained.

(Other)

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to preferred embodiments, and it will now be apparent that changes and modifications may be made without departing from the invention in its broader aspects, and it is the intention, therefore, in the appended claims to cover all such changes and modifications as fall within the true spirit of the invention.

What is claimed is:

1. A recording head, comprising:

a recording element unit comprising;

a plurality of recording elements; and at least a first bump-shaped electrode for electrical connection; and a drive element unit comprising:

a plurality of drive elements for driving said recording elements of said recording element unit; and at least a second bump-shaped electrode for electrical connection, wherein said recording element unit and said drive element unit are electrically connected by mutual bonding of said first and said second bump-shaped electrodes, and a Young's modulus of a material forming one said bump-shaped electrode of said two units is smaller than a Young's modulus of a material forming the other said bump-shaped electrode of said two units.

2. The recording head as claimed in claim 1, wherein one of said two units provided with said one bump-shaped electrode that is formed of a material having the smaller Young's modulus is a unit for being replaced.

3. The recording head as claimed in claim 2, wherein said unit for being replaced is said recording element unit.

4. The recording head as claimed in claim 1, wherein said one bump-shaped electrode formed of said material having the smaller Young's modulus has a shape which decreases in sectional area towards said bonding direction.

5. The recording head as claimed in claim 1, wherein each said recording element of said recording element unit has a heat energy generator for generating a bubble in ink utilizing heat energy and ejecting ink by a pressure of said bubble.

6. A recording head according to claim 1, wherein the Young's modulus of the material forming one said bump-shaped electrode of said two units and the Young's modulus of the material forming the other said bump-shaped electrode of said two units differ by at least $2.8\times10^{10}$ Pa.

7. A recording head, comprising:

a recording element unit comprising:

a plurality of recording elements; and at least a first bump-shaped electrode for electrical connection; and a drive element unit comprising;

a plurality of drive elements for driving said recording elements of said recording element unit; and at least a second bump-shaped electrode for electrical connection, wherein said recording element unit and said drive element unit are electrically connected by mutual bonding of said first and said second bump-shaped electrodes, and one said bump-shaped electrode of said two units has a shape which decreases in sectional area along a bonding direction.

8. The recording head as claimed in claim 7, wherein said one bump-shaped electrode is formed of a material relatively having a smaller Young's modulus and one of said two units provided with said one bump-shaped electrode is a unit for being replaced.

9. The recording head as claimed in claim 7, wherein said unit for being replaced is said recording element unit.

10. The recording head as claimed in claim 7, wherein each said recording element of said recording element unit has a heat energy generator for generating a bubble in ink utilizing heat energy and ejecting ink by a pressure of said bubble.

11. A recording apparatus for recording on a recording medium using a recording head having a recording element unit provided with a plurality of recording elements and at least a first bump-shaped electrode for electrical connection, and a drive element unit provided with a plurality of drive elements for driving said recording elements of said recording element unit and at least a second bump-shaped electrode for electrical connection, said recording element unit and said drive element unit are electrically connected by mutual bonding of said first and said second bump-shaped electrodes, and a Young's modulus of a material forming one said bump-shaped electrode of said two units is smaller than a Young's modulus of a material forming the other said bump-shaped electrode of said two units, comprising;

a support which holds said recording head such that an ejection port surface of said recording head opposes a surface of said recording medium with a predetermined spacing.

12. A recording apparatus according to claim 11, wherein the Young's modulus of the material forming one said bump-shaped electrode of said two units and the Young's modulus of the material forming the other said bump-shaped electrode of said two units differ by at least $2.8\times10^{10}$ Pa.

13. A recording apparatus for recording on a recording medium using a recording head having a recording element unit provided with a plurality of recording elements and at least a first bump-shaped electrode for electrical connection, and a drive element unit provided with a plurality of drive elements for driving said recording elements of said recording element unit and at least a second bump-shaped electrode for electrical connection, said recording element unit and said drive element unit are electrically connected by mutual bonding of said first and said second bump-shaped electrode, and one said bump-shaped electrode of said two units has a shape which decreases in sectional area along a bonding directions comprising;

a support which holds said recording head such that an ejection port surface of said recording head opposes a surface of said recording medium with a predetermined spacing.

* * * * *

UNITED STATES PATENT AND TRADEMARK OFFICE

CERTIFICATE OF CORRECTION

PATENT NO. : 6,186,613 B1
DATED : February 13, 2001
INVENTOR(S) : Yasutomo Watanabe It is certified that error appears in the above-identified patent and that said Letters Patent is hereby corrected as shown below:

Title page,
Item [57] ABSTRACT,
Line 2, "and" should be deleted;
Line 6, "the" (second occurrence) should read -- the other --; and
Line 8, "for itself" should be deleted.

Column 1,
Line 22, "are" should read -- is --; and
Line 35, "connected" should read -- connected to --.

Column 2,
Line 20, "contacts" should read -- contacting --.

Column 3,
Line 11, "another" should read -- other --.

Column 4,
Line 10, "it is general that" should read -- in general --.

Column 5,
Line 10, "for" should read -- into --; and
Line 22, "cross sectional" should read -- cross-sectional --.

Column 6,
Lines 29, 35, 41, 47 and 53, "process" should read -- processes --.

Column 7,
Line 49, "of relatively smaller in" should read -- with relatively smaller --;
Line 51, "of" should read -- with --; and
Line 52, "in" should be deleted.

Column 8,
Line 20, "11.3 A" should read -- 11.3 C --; and
Line 40, "is" should read -- be --.

Column 9,
Line 60, "abovedescribed" should read -- above-described --.

UNITED STATES PATENT AND TRADEMARK OFFICE

CERTIFICATE OF CORRECTION

PATENT NO. : 6,186,613 B1
DATED : February 13, 2001
INVENTOR(S) : Yasutomo Watanabe It is certified that error appears in the above-identified patent and that said Letters Patent is hereby corrected as shown below:

Column 10,
Line 12, "is possible to" should be deleted;
Line 14, "make" should read -- enables --;
Line 21, "of" should read -- with --;
Line 22, "in" should be deleted;
Line 25, "for" should read -- into --; and
Line 41, "whereby" should be deleted.

Column 11,
Line 13, "to" should read -- into --;
Line 31, "consists" should read -- consist --; and
Line 55, "be also" should read -- also be --.

Column 12,
Line 3, "in" should read -- at --; and
Line 37, "comprising;" should read -- comprising: --.

Column 13,
Line 11, "comprising;" should read -- comprising: --.

Column 14,
Line 9, "comprising;" should read -- comprising: --;
Line 29, "electrode," should read -- electrodes, --; and
Line 31, "directions comprising;" should read -- direction, comprising: --.

Signed and Sealed this

Twenty-sixth Day of February, 2002

*Attest:*

*Attesting Officer*

JAMES E. ROGAN
*Director of the United States Patent and Trademark Office*